United States Patent [19]

Stahlecker et al.

[11] Patent Number: 4,866,925

[45] Date of Patent: Sep. 19, 1989

[54] ARRANGEMENT FOR OPEN-END ROTOR SPINNING HAVING A SPINNING ROTOR

[75] Inventors: Fritz Stahlecker, Josef-Neidhart-Strasse 18, 7347 Bad Überkingen; Wolfgang Feuchter, Deggingen-Reichenbach, both of Fed. Rep. of Germany

[73] Assignees: Fritz Stahlecker; Hans Stahlecker, both of Fed. Rep. of Germany

[21] Appl. No.: 240,197

[22] Filed: Sep. 6, 1988

[30] Foreign Application Priority Data

Sep. 12, 1987 [DE] Fed. Rep. of Germany ..... 3730705

[51] Int. Cl.[4] ..... D01H 7/885

[52] U.S. Cl. ..... 57/301; 57/304; 57/400

[58] Field of Search ..... 57/88, 89, 92, 104, 57/105, 78, 300–302, 406

[56] References Cited

U.S. PATENT DOCUMENTS

| | | | |
|---|---|---|---|
| 3,868,815 | 3/1975 | Stahlecker | 57/406 X |
| 4,183,199 | 1/1980 | Shumann | 57/406 X |
| 4,617,792 | 10/1986 | Stahlecker | 57/301 X |
| 4,703,616 | 11/1987 | Feuchter et al. | 57/406 X |
| 4,704,857 | 11/1987 | Stahlecker | 57/301 X |
| 4,745,738 | 5/1988 | Stahlecker | 57/301 |
| 4,760,688 | 8/1988 | Beitzinger | 57/406 X |
| 4,763,465 | 8/1988 | Raasch | 57/406 X |

*Primary Examiner*—Donald Watkins

*Attorney, Agent, or Firm*—Barnes & Thornburg

[57] ABSTRACT

In an arrangement for open-end rotor spinning having a spinning rotor which, by means of a rotor shaft, is disposed in wedge-shaped gaps formed by pairs of supporting disks and is driven by means of a tangential belt, it is provided that a cleaning element is assigned to the peripheral area of the pressure roller.

17 Claims, 6 Drawing Sheets

ARRANGEMENT FOR OPEN-END ROTOR SPINNING HAVING A SPINNING ROTOR

BACKGROUND AND SUMMARY OF THE INVENTION

The invention relates to an arrangement for open-end rotor spinning having a spinning rotor which is supported at a rotor shaft which is disposed in wedge-shaped gaps formed by pairs of supporting disks. The rotor shaft is driven by means of a tangential belt which is loaded in the direction toward the rotor shaft by means of a pressure roller arranged on a movable arm loaded by a spring. This pressure roller is capable of being moved away from the tangential belt for interrupting the drive of the spinning rotor.

Arrangements of the initially mentioned type, as known, for example, from DE-A-34 24 511, are used very successfully in open-end rotor spinning because they permit very high rotational speeds of the rotor.

An object of the invention is to develop an arrangement of the initially mentioned type such that the running properties are improved.

This object is achieved according to the invention by assigning a cleaning element to the peripheral area of the pressure roller.

The invention is based on the recognition that, in practice, difficulties may arise because of the fact that the peripheral area of the pressure roller which is in contact with the tangential belt may pick up dirt deposits. These deposits may be of such an extent that the pressure rollers can no longer run quietly and smoothly. As a result, operating noises are increased, on the one hand, while, on the other hand, the bearings of the supporting disks as well as the bearing of the pressure roller are stressed more extensively. These problems are avoided by means of the cleaning element.

In a further development of preferred embodiments of the invention, it is provided that the cleaning element is constructed as a friction element. This results in a very simple structural design which requires only relatively low expenditures.

In a further development of preferred embodiments of the invention, it is provided that, between the cleaning element and the pressure roller, a space is left which can be bridged by moving the pressure roller and/or the cleaning element. In this development, the pressure roller and the cleaning element are not in constant contact. They are brought in contact with one another only at intervals, for example, at regular intervals or whenever there is a yarn breakage and the drive of the spinning rotor is interrupted anyhow.

In certain preferred embodiments of the invention, it is provided that the cleaning element is held by means of a holding device in the moving path of the pressure roller, along which path the pressure roller moves when moving away from the tangential belt. As a result, it is ensured that a cleaning of the pressure roller takes place during each interruption of the drive.

In a further development of preferred embodiments of the invention, it is provided that the pressure roller is equipped with collars which, when the drive is interrupted, move against the shaft of the spinning rotor. Thus, the collars take over the radial securing of the shaft of the spinning rotor as soon as the radial position securing which in the normal operation is carried out by the tangential belt is largely discontinued.

In a further development of preferred embodiments of the invention, it is provided that the collars are constructed as friction linings. As a result, it becomes possible to brake the rotor shaft via the pressure roller or its collars in such a manner that additional braking elements are not required. In order to keep the masses that have to be braked small, it is provided in a further development of the invention that the collars are rotatably mounted with respect to the pressure roller and their own braking elements are assigned to them. When the pressure roller, via the collars, takes over the function of the rotor shaft brake, the space in the axial direction of the rotor shaft between the supporting disks may be relatively small so that, as a result, a reduction of the axial length of the rotor shaft is obtained. As a result, extremely high rotational speeds may be obtained without any passing through the critical rotational speed for the spinning rotor.

In a further development of preferred embodiments of the invention, it is provided that the cleaning element is held and can be applied to the pressure roller by means of a movable holding device. In an expedient development, it is provided in this case that the cleaning element is constructed as a lift-off device for the pressure roller. In this case, during the stoppage, the lift-off roller is lifted off by means of the cleaning element so that, in this case also, a cleaning process is automatically associated with any stoppage.

Particularly, when the cleaning element can be applied to the pressure roller according to certain preferred embodiments, it is possible to clean the pressure roller in selectable intervals without interrupting the drive for this purpose. In this case, it is possible that the application of the cleaning element to the pressure roller is triggered by means of an automatic servicing apparatus which patrols along a spinning machine which is equipped with a plurality of spinning devices or units of this type.

Other objects, advantages and novel features of the present invention will become apparent from the following detailed description of the invention when considered in conjuction with the accompanying drawings.

DETAILED DESCRIPTION OF THE DRAWINGS

Figure 1:
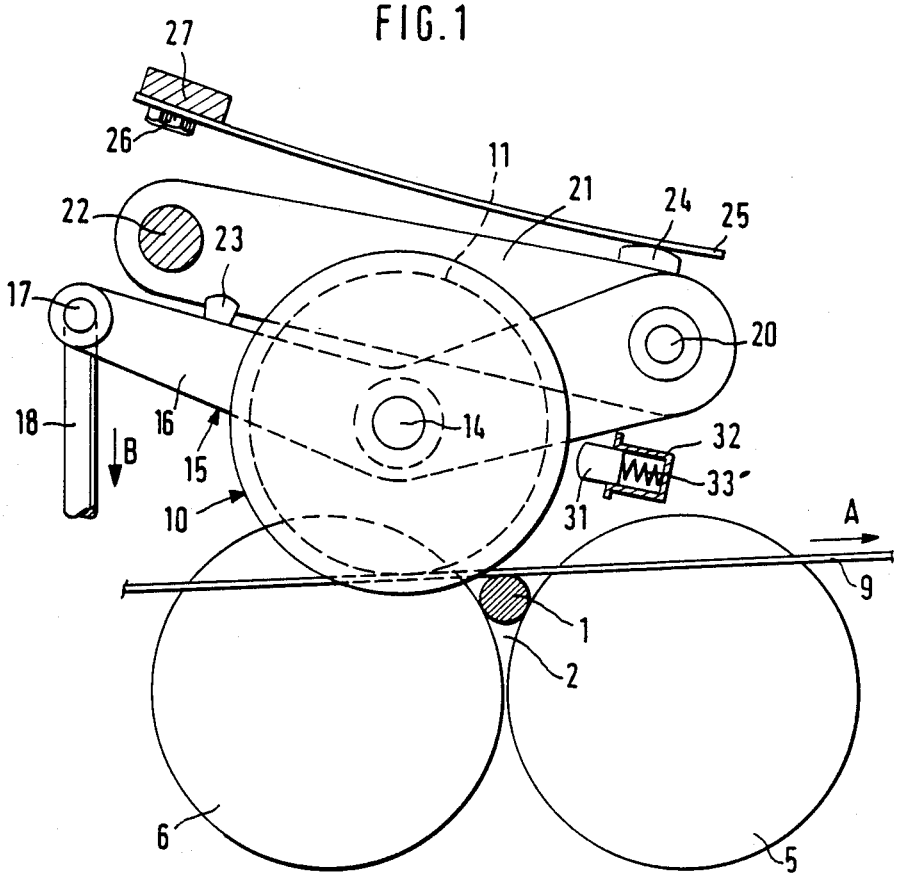
FIG. 1 is a schematic part sectional view of a bearing and of a drive for an open-end spinning rotor, taken in the longitudinal direction of the rotor shaft, showing a preferred embodiment of the present invention in a spinning operating condition.

In the various drawing figures like reference characters are used to designate similar elements.

Figure 2:
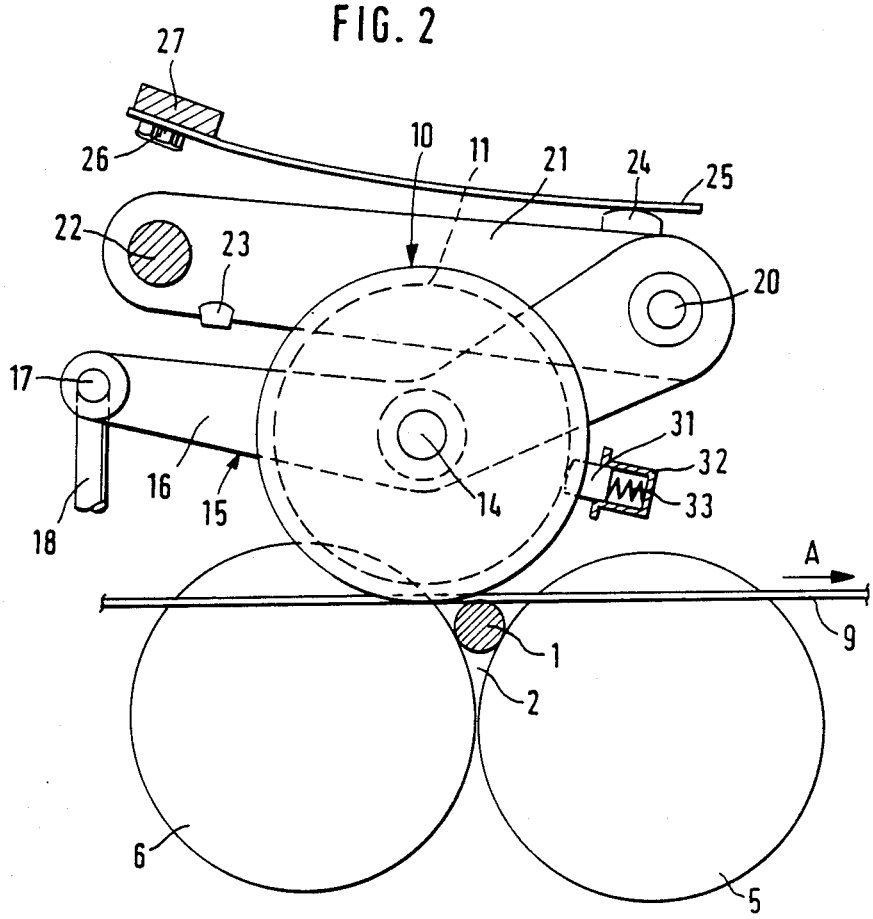
FIG. 2 is a view corresponding to FIG. 1, showing the condition that exists while the operation is interrupted.
Figure 3:
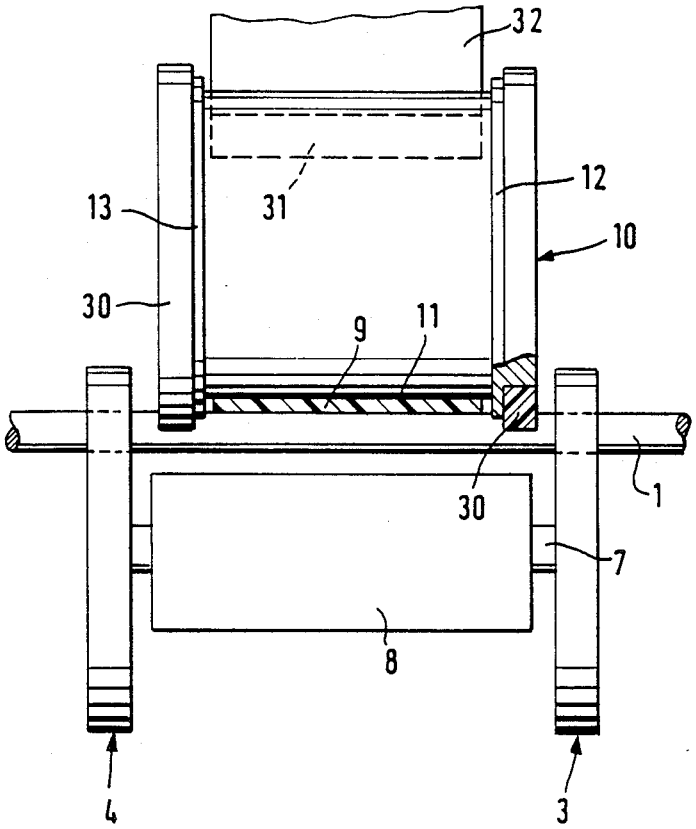
FIG. 3 is a view of the arrangement according to FIGS. 1 and 2, taken in the travel direction of the tangential belt driving the rotor shaft.

In the embodiment according to FIGS. 1 to 3, the rotor shaft 1 of a spinning rotor is supportingly disposed in two wedge-shaped gaps 2 formed by pairs 3, 4 of supporting disks. The wedge-shaped gaps 2 are each formed by two supporting disks 5, 6, in which case the supporting disks 5, which are each located on one side of the shaft 1, as well as the supporting disks 6, are disposed on joint shafts 7 in bearing housings 8 (FIG. 3). The bearing housings 8 are housed in a joint holding device which has corresponding receiving means for the bearing housings 8.

The shaft 1 of the spinning rotor is equipped with a rotor at one end, which rotor is not shown. The other end is axially supported in a step bearing which is not shown. See the above noted DE-A 34 24 511 for exemplary arrangements of rotor and step bearing that could be utilized. By means of a skew arrangement of the shafts 7 of the supporting disks 5, 6, an axial push is generated that acts in the direction toward the axial step bearing. The rotor shaft 1 is driven directly by means of a tangential belt 9 which moves up against it and extends through in the direction of the Arrow (A) and which drives the rotor shafts 1 of a plurality of spinning units of one side of a spinning machine that are arranged in a row adjacent one another. The tangential belt 9, in direct vicinity of the rotor shaft 1, is loaded by means of a pressure roller 10 which presses the tangential belt 9 against the rotor shaft 1 and therefore provides that the rotor shaft 1, in the operating condition, is secured in the wedge-shaped gaps 2 in the radial direction. The pressure roller 10 has a running surface 11 for the tangential belt 9 which is slightly wider than the tangential belt 9 and which is limited by means of collars 12, 13.

The pressure roller 10 is rotatably supported at a double-armed lever 15 for rotation around a shaft 14. One arm 16 of the double-armed lever 15 is connected via a pivot joint 17 with a pull rod 18 which can be adjusted vertically in the direction of the Arrow (B). The end of the other arm of the double-armed lever 15 is connected via a joint 20 with a swivel arm 21 which is pivotally held at the machine frame at a stationary shaft 22 that is parallel to the rotor shaft 1. At the swivel arm 21, a thrust piece 24 is mounted in the vicinity of the joint 20. A leaf spring 25 rests against thrust piece 24, which thrust piece 24 is fastened by means of a screw 26 to a structural member 27 of the machine frame. The leaf spring 25 loads the swivel arm 21 and thus also the pressure roller 10 in the direction toward the tangential belt 9. In the area of the stationary shaft 22 and of the joint 17, a thrust piece 23, which is preferably made of plastic, is arranged between the swivel arm 21 and the arm 16 of the double-armed lever 15.

In the normal spinning operating position (FIG. 1), the swivel arm 21 and the double-armed lever 15 act like a one-piece member, i.e., as a loading device for the pressure roller 10 which can be pivoted around the shaft 22 and by means of which the pressure roller 10 is loaded in the direction toward the tangential belt 9.

By a pulling at the pull rod 18 in the direction of the Arrow (B), the double-armed lever 15 is swivelled counterclockwise around the joint 20 until the pressure roller collars 12, 13 place themselves against the shaft 1. A further pulling at the pull rod 18 has the result that subsequently the swivel arm 21 is swivelled around its stationary shaft 22, in which case the pressure roller 10 still moves a little further over the shaft 1. As shown in FIG. 2, in this position, the running surface 11 of the pressure roller 10 is lifted off the tangential belt 9 which then moves over the shaft 1 practically without any significant pressing force. In this position, the shaft 1 is pressed by means of the collars 12, 13 of the pressure roller 10 into the wedge-shaped gaps 2 and is therefore secured in its radial position.

A cleaning element 31 is assigned to the running surface 11 of the pressure roller 10. This cleaning element 31 is arranged in the moving path of the pressure roller 10, along which the pressure roller 10 moves when it changes from the operating position (FIG. 1) to the position (FIG. 2) interrupting the operation, in such a manner that this cleaning element 31 places itself against the running surface 11. The cleaning element 31 has a width which corresponds at least approximately to the axial course of the running surface 11. In the shown embodiment, the cleaning element 31 is constructed as a friction element. In a modified embodiment, a brush or a scraper or the like is provided as the friction element. The friction element 31 is guided in a guide 32 and is held by means of a pressure spring 33. As shown in FIG. 2, the cleaning element 31 therefore yields elastically when the running surface 11 of the pressure roller 10 strikes against the cleaning element 31.

As shown in FIG. 3, the collars 12, 13 of the pressure roller 10 are provided with friction linings 30 which project beyond the actual collars 12, 13 in radial direction and move against the rotor shaft 1. Since the cleaning element 31, developed as a friction element, brakes the pressure roller 10, this braking effect, via the friction linings 30, is transmitted to the rotor shaft 1 of the spinning rotor. It is therefore possible to do without any additional brakes, particularly since also the rotor shaft 1 of the spinning rotor is secured sufficiently in the wedge-shaped gaps 2 when the operation is interrupted.

Figure 4:
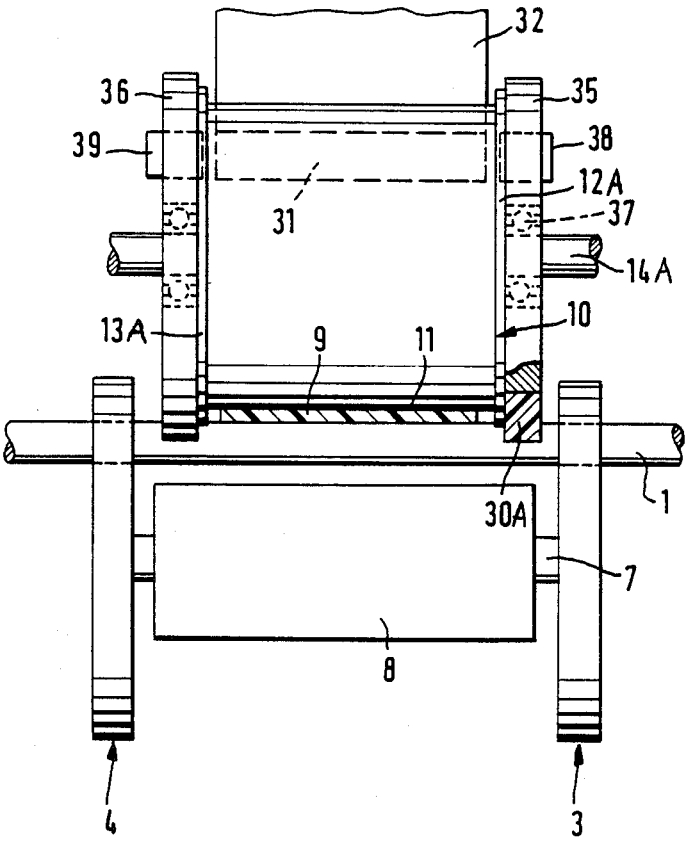
FIG. 4 is a view, similar to FIG. 3, of a modified embodiment of the invention.

As a modification of the embodiment of FIG. 1 to 3, it is provided in the embodiment according to FIG. 4 that the collars 12A, 13A are constructed as rings 35, 36 that can be rotated freely around the shaft 14A of the pressure roller 10A by means of roller bearings 37, these rings 35, 36 also being equipped with friction linings 30A. Their own braking elements 38, 39 are assigned to these rings 35, 36 so that, when the operation is interrupted, the whole mass of the pressure roller 10A does not have to be braked in order to stop the spinning rotor.

The force of the spring 33 is expediently adjustable so that the force is adjustable by means of which the cleaning element 31 is pressed against the running surface 11. As a result, the cleaning effect can be apportioned.

Figure 5:
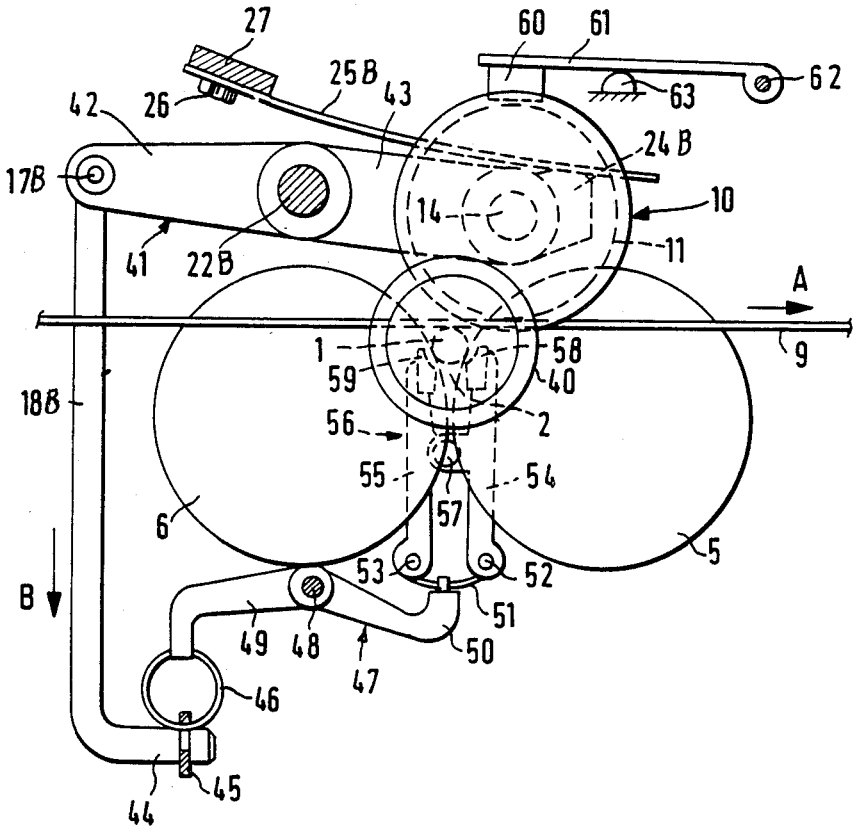
FIG. 5 is a view, similar to FIG. 1, of an arrangement in the operating position with an additional clasp brake for the spinning rotor constructed in accordance with another preferred embodiment of the invention.

In the embodiment according to FIG. 5, the pressure roller 10B is held by means of a double-armed lever 41 which is disposed around a stationary shaft 22B in the machine frame. One arm 43 carries the pressure roller 10 which is freely rotatable around a shaft 14 that is essentially in parallel with the rotor shaft 1. At the other arm 42, the pull rod 18B is coupled by means of a pivot joint 17B, this pull rod 18B, via an actuating element 45 engaging at a bent part 44, being movable in the direction of the Arrow (B). The leaf spring 25B, in the embodiment according to FIG. 5, places itself against a thrust piece 24B which is mounted at the arm 43 of the lever 41.

A braking mechanism 56 for the shaft 1 of the spinning rotor is connected via a spring ring 46 with the pull rod 18B or with the actuating element 45. This braking mechanism 56 contains a double-armed lever 47 which is pivoted around a shaft 48 that is in parallel to the shaft 1. One arm 49 is joined to the elastic connecting element spring ring 46. The other arm 50 acts upon a curved bow spring 51 acting as a spreading spring, the two ends 52, 53 of which are coupled to two tong arms 54, 55. The ends of the tong arms 54, 55 facing the rotor shaft 1, which are pivotable around a shaft 57 extending below shaft 1 and essentially in parallel to it, are provided with brake linings 58, 59 which are applied to the shaft 1 in the manner of tongs.

By the actuating of the pull rod 18B, in the embodiment according to FIG. 5, the pressure roller 10 is lifted upwards off the tangential belt 9 against the effect of the leaf spring 25. In the moving path of the pressure roller 10, a cleaning element 60 is located which is developed as a friction element and has approximately the axial width of the running surface 11 of the pressure roller 10. This cleaning element 60 is held by a lever 61 which is disposed around a shaft 62 that is essentially in parallel with respect to the shaft 1. The lever 61 rests on a stop 63 which is arranged or adjusted such that, in the spinning operating position shown in FIG. 5, the cleaning element 60 is spaced from the running surface 11, but contacts the running surface 11 when the spinning unit rotor shaft drive is interrupted.

Figure 6:
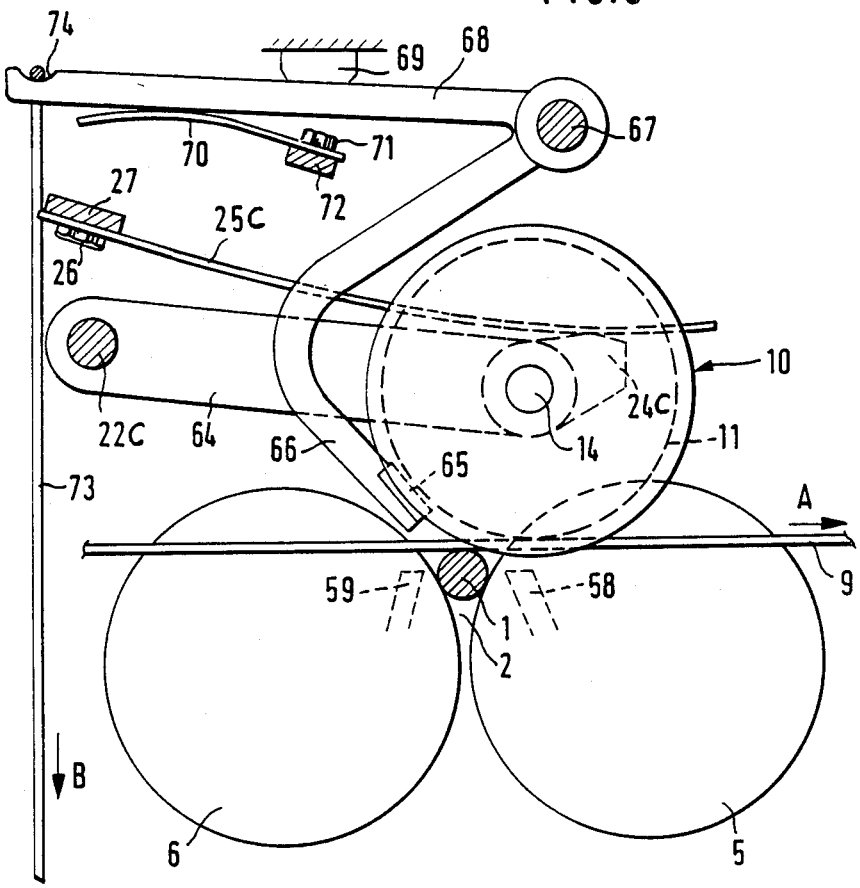
FIG. 6 is a view, similar to FIG. 1, of another preferred embodiment of the invention.

In the embodiment according to FIG. 6, the pressure roller 10, by means of a shaft 14, is disposed at a pivoted lever 64 which can be pivoted around a stationary shaft 22C. The pivoted lever 64, via a thrust piece 24C, is loaded by the leaf spring 25 such that the pressure roller 10 is pressed against the tangential belt 9. In addition, a mechanism is provided which, with a cleaning element 65, particularly a friction element, is applied to the running surface 11 of the pressure roller 10 in such a manner that this pressure roller 10 is lifted off the tangential belt 9 from the operative position into the inoperative position, via the cleaning element 65.

The cleaning element 65 of the embodiment according to FIG. 6 is arranged on a bent arm 66 which can be pivoted around a shaft 67 located above the pressure roller 10 and extending essentially in parallel with respect to the rotor shaft 1. The arm 66 is non-rotatably connected with another arm 68 which, by means of a leaf spring 70, is held against a stationary stop 69 in the operative position, i.e., in which the cleaning element 65 has a distance from the pressure roller 10. The leaf spring 70, by means of a screw 71, is fastened at a structural part 72 of the machine frame. A pull element 73 is hung into a notch 74 of the lever 68 and can be pulled downward in the direction of the Arrow B. By means of this movement, the lever arm 66 is swivelled counterclockwise so that the cleaning element 65 places itself against the running surface 11 of the pressure roller 10 and lifts it off the tangential belt 9, when it moves further along, by a pivoting around the stationary shaft 22C.

In all embodiments, it is provided that the cleaning element 31 or 60 or 65 always comes in contact with the running surface 11 of the pressure roller 10 when the drive is interrupted. In an arrangement for open-end rotor spinning, this always takes place when a yarn breakage occurs and, after the yarn breakage, a piecing must be carried out. As a rule, this also takes place when spools and packages are exchanged. In addition, it is also customary that a so-called preventive cleaning is provided for the spinning rotors during which, in each case, a yarn breakage is produced so that subsequently a piecing must be carried out with an interruption of the drive of the spinning rotor which, in the embodiments according to the invention, is associated with a cleaning of the running surface 11 for the tangential belt 9. In addition, it may also be provided that, irrespective of an interruption of the operation, a cleaning takes place which is carried out, for example, by means of a corresponding actuating element of a movable servicing device. In this case, it is contemplated, in the embodiment according to FIGS. 1 to 3, to develop the holding device 32 of the cleaning element 31 such that the cleaning element 31 can be applied to the pressure roller 10 located in the operative position.

In the construction according to FIG. 5, modified embodiments are contemplated wherein the swivel arm 61 is formed by a leaf spring so that, by means of a corresponding actuating element, the swivel arm 61 can be deformed such that the distance is bridged between the cleaning element 60 and the running surface 11 of the pressure roller 10. In this case, the pressure roller 10 remaining in the operative position may also be cleaned.

With respect to the embodiment according to FIG. 6, modified embodiments are contemplated wherein it is possible, via the pull element 73, to swivel the cleaning element 65 only onto the pressure roller 10 so that its running surface 11 is cleaned, without moving the pressure roller 10 out of the operative position. Under certain circumstances, it is also not interfering that the pressure roller 10, for a short time, is lifted out of the operative position because, for a period of 1 or 2 seconds, the rotor does not suffer any significant loss of speed and the shaft 1 does not move out of the wedge-shaped gaps 2.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. An arrangement for open-end rotor spinning, comprising:
   - a rotor shaft,
   - a spinning rotor supported on the rotor shaft,
   - supporting disk means forming a wedge shaped gap within which the rotor shaft is supported,
   - tangential belt means selectively engageable with the rotor shaft to drive the rotor shaft,
   - a pressure roller aranged on a movable arm loaded by a spring and movable between a tangential belt drive driving position pressing the tangential belt against the peripheral area of the rotor shaft and a tangential belt drive interrupt position with the tangential belt out of driving contact with the rotor shaft,
   - and a cleaning element for cleaning the peripheral area of the pressure roller.

2. An arrangement according to claim 1, wherein the cleaning element is constructed as a friction element.

3. An arrangement according to claim 1, wherein the cleaning element and the pressure roller are separated by a space during normal spinning operations, and wherein means are provided for moving at least one of the pressure roller and the cleaning element when the rotor shaft drive is interrupted.

4. An arrangement according to claim 2, wherein the cleaning element and the pressure roller are separated by a space during normal spinning operations, and wherein means are provided for moving at least one of the pressure roller and the cleaning element when the rotor shaft drive is interrupted.

5. An arrangement according to claim 1, comprising a holding device for holding the cleaning element in the moving path of the pressure roller so that the pressure roller moves into engagement with the cleaning element when moving away from the tangential belt.

6. An arrangement according to claim 3, comprising a holding device for holding the cleaning element in the moving path of the pressure roller so that the pressure roller moves into engagement with the cleaning element when moving away from the tangential belt.

7. An arrangement according to claim 5, wherein the holding device for the cleaning element is a spring element.

8. An arrangement according to claim 5, wherein the holdiang device for the cleaning element is a swivel arm for pivotally holding the cleaning element.

9. An arrangement according to claim 1, wherein the pressure roller is equipped with collars which, when the drive is interrupted, move against the rotor shaft of the spinning rotor.

10. An arrangement according to claim 3, wherein the pressure roller is equipped with collars which, when the drive is interrupted, move against the rotor shaft of the spinning rotor.

11. An arrangement according to claim 9, wherein the collars are constructed as friction linings.

12. An arrangement according to claim 9, wherein the collars are rotatable with respect to the pressure roller and respective braking elements are assigned to them.

13. An arrangement according to claim 10, wherein the collars are rotatable with respect to the pressure roller and respective braking elements are assigned to them.

14. An arrangement according to claim 1, wherein a movable holding device is provided for holding the cleaning element and applying the same to the pressure roller.

15. An arrangement according to claim 9, wherein a movable holding device is provided for holding the cleaning element and applying the same to the pressure roller.

16. An arrangement according to claim 14, wherein the cleaning element is constructed as a lift-off device for the pressure roller.

17. An arrangement according to claim 15, wherein the cleaning element is constructed as a lift-off device for pressure roller.

* * * * *